US005729998A

United States Patent [19]

Grohs et al.

[11] Patent Number: 5,729,998

[45] Date of Patent: Mar. 24, 1998

[54] ACCUMULATOR FOR AN AIR CONDITIONING SYSTEM

[75] Inventors: David Donald Grohs, Shelby Township; Fred Georg Schroeder, Gross Ile, both of Mich.

[73] Assignee: Ford Motor Company, Dearborn, Mich.

[21] Appl. No.: 732,082

[22] Filed: Oct. 16, 1996

[51] Int. Cl.[6] ..... F25B 43/00

[52] U.S. Cl. ..... 62/474; 62/503; 29/890.06

[58] Field of Search ..... 62/503, 474, 475, 62/83; 29/890.06

[56] References Cited

U.S. PATENT DOCUMENTS

| | | | |
|---|---|---|---|
| 4,994,185 | 2/1991 | Cullen et al. | 62/503 |
| 5,177,982 | 1/1993 | Plemens . | |
| 5,419,157 | 5/1995 | Kiblawi et al. | 62/503 |

*Primary Examiner*—John M. Sollecito
*Attorney, Agent, or Firm*—Raymond L. Coppiellie

[57] ABSTRACT

A heat shield for an accumulator used in automotive air conditioning systems is disclosed. The heat shield prevents overheating of the interior components of the accumulator while the accumulator is being manufactured.

6 Claims, 2 Drawing Sheets

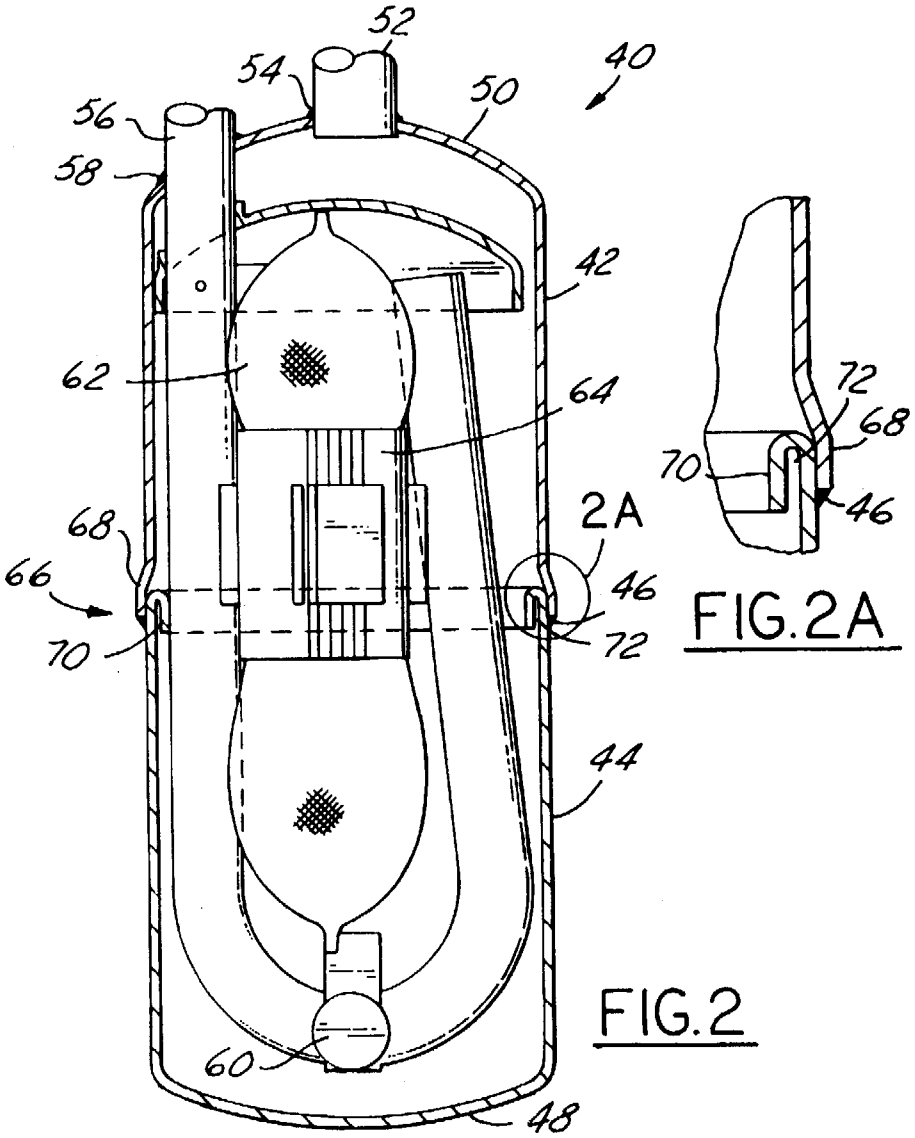
FIG.2
FIG.2A
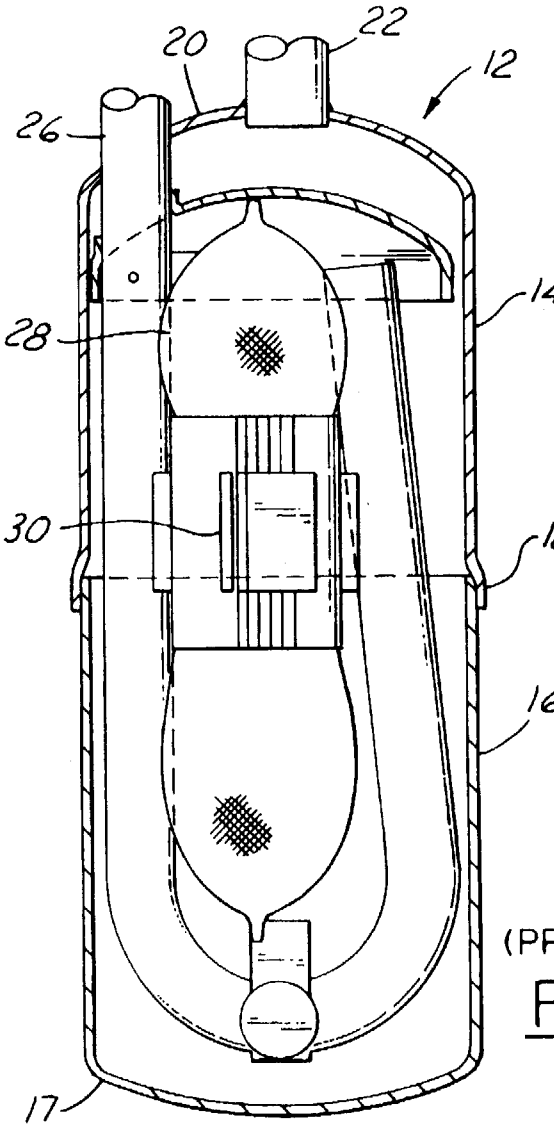
(PRIOR ART)
FIG.1

ACCUMULATOR FOR AN AIR CONDITIONING SYSTEM

BACKGROUND OF THE INVENTION

1. Field of the Invention

The present invention relates generally to accumulators for automotive air conditioning systems. More particularly, the present invention relates to an accumulator having a heat shield for preventing overheating of the accumulator while the accumulator is being fabricated.

2. Disclosure Information

FIG. 1 shows a known construction of an automotive air conditioning accumulator 12 comprising an upper housing member 14 and a lower housing member 16. The members 14 and 16 are joined together in abutting relationship at a predefined seam location 18 by means of an overlapping brazed or welded juncture. The lower end of the accumulator is closed by lower wall 19 and the upper end of the accumulator is closed by a domed upper wall. An inlet tube 22 is received in an opening formed in the center of the domed wall 20 and is brazed thereat. An outlet tube 26 extends through another opening in the domed wall 20 adjacent to the inlet tube 22 and it too is brazed to provide a pressure seal and a permanent juncture with the wall 20.

As is also known, the outlet tube 26 extends vertically adjacent the inner wall of the accumulator and is curved at its lowermost portion. The accumulator further includes an adsorbent device, such as a flexible bag of desiccant 28 interposed between the vertical sections of the curved outlet tube 26. A retaining clip 30 secures the desiccant bag 28 to each side of the outlet tube 26. This construction is known as disclosed in U.S. Pat. No. 4,474,035 as well as U.S. Pat. No. 5,177,982, assigned to the assignee of the present invention, the disclosure which is hereby incorporated by reference.

During the fabrication of the accumulator 12 shown in FIG. 1, the upper housing member 14 is secured to the lower housing member 16 by welding at the seam location 18 as described above. However, by welding at this location, the weld heat produced can be transmitted to the desiccant bag 28 and its retaining clip 30 and could potentially damage any of these components. If these components are damaged, the air conditioning system can become compromised due to particulate matter being introduced into the system. Furthermore, because the accumulator has a sealed cylindrical housing, it is not possible to view the internal components of the accumulator after the upper and lower housing members have been welded together. Therefore, it would be advantageous to prevent the weld heat from being transferred to the interior components of the accumulator during the manufacturing process.

A number of solutions to this problem have been proposed. Typically, the desiccant bag and retaining clip are surrounded by an aluminum, reflective type of material to prevent the weld heat from reaching or harming the interior components of the accumulator. Furthermore, as disclosed in the '982 patent, the retaining clip holding the desiccant bag can be formed from a material which prevents heat damage to the desiccant bag. However, these designs are expensive and labor intensive solutions to the problem. Therefore, it would be advantageous to provide a mechanism for preventing heat from entering the accumulator without such expensive and labor consuming solutions.

SUMMARY OF THE INVENTION

It is an object of the present invention to provide means for preventing overheating in the internal cavity of the accumulator to prevent damage to the desiccant bag and holder during the fabrication process.

In one principle aspect of the present invention there is provided an accumulator for an automotive air conditioning system comprising a generally cylindrical housing having a top housing member and a bottom housing member, the top and bottom housing members being joined together at a seam to define an internal cavity for storing a desiccant material therein. A fluid transport tube is disposed through the top housing member and into the internal cavity of the accumulator. A desiccant material is stored in a desiccant holder within the internal cavity. The present invention further includes means for preventing overheating in the internal cavity and damage to the desiccant holder and material while the top and bottom housing members are being joined together. In the preferred embodiment, the means for preventing weld heat from reaching the internal cavity of the accumulator comprises a heat shield having an air gap spaced a predetermined distance from the internal components of the accumulator to prevent overheating thereof.

These and other objects, features and advantages of the present invention will become apparent from the detailed description, drawings and claims which follow.

BRIEF DESCRIPTION OF THE DRAWINGS

FIG. 1 is a cross-sectional view of a prior art accumulator.

FIGS. 2–4 are cross-sectional views of a number of alternative embodiments of accumulators structured in accord with the principles of the present invention.

FIGS. 2A, 3A and 4A are enlarged views of a portion of FIGS. 2, 3 and 4, respectively.

DETAILED DESCRIPTION OF THE PREFERRED EMBODIMENTS

Figure 4A:
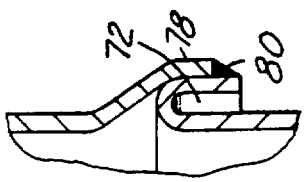
Figure 4:
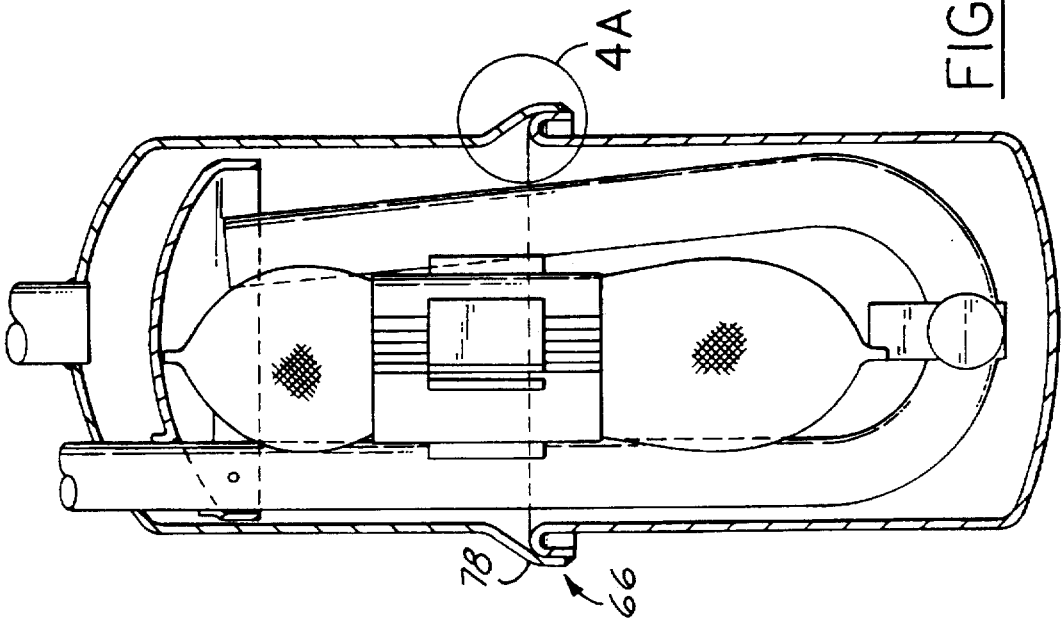
Figure 3A:
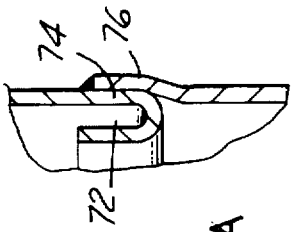
Figure 3:
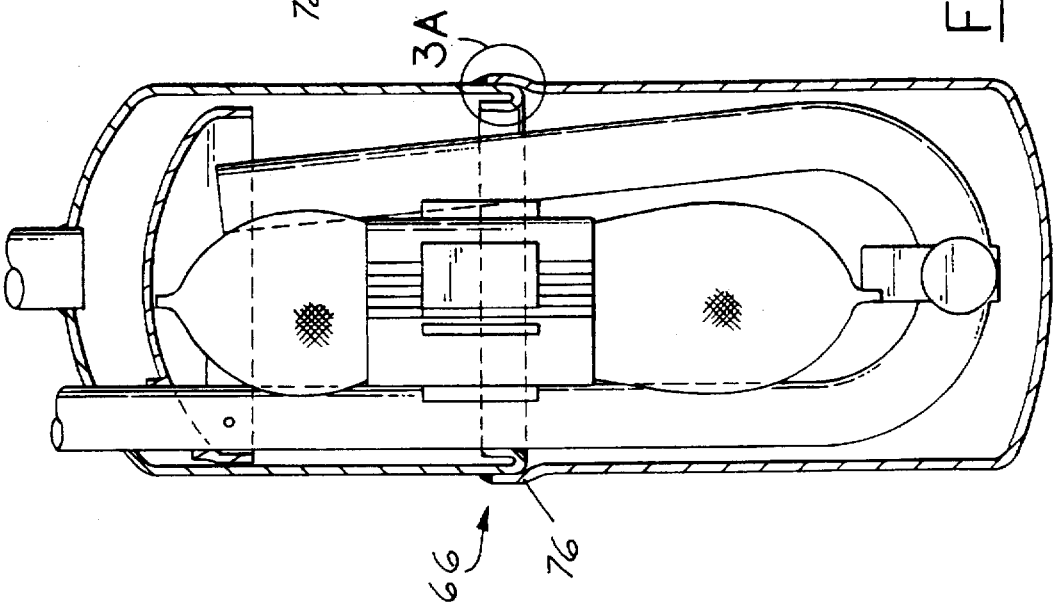

Referring now to the drawings, FIGS. 2–4 show an accumulator assembly for use in an automotive air conditioning system of the type known in the art, including three different embodiments of the present invention. As is well understood to one of ordinary skill in the art, but not shown in the drawings, the air conditioning system includes a compressor, the output of which flows to a condenser through a liquid line with an orifice tube (such as in a known, clutch cycling orifice tube configuration), then to an evaporator and then to an accumulator of the present invention and finally back to the compressor. In FIGS. 2–4, like components will be described with the same reference numerals for ease of description. As is shown in FIGS. 2–4, the accumulator 40 includes a cylindrical housing comprising an upper or top housing member 42 and a lower or bottom housing member 44. The members 42 and 44 are joined together in abutting relationship at a predefined seam location 46 by means of an overlapping welded juncture. The lower housing member 44 is generally cylindrical and is closed by a lower wall 48, and the upper housing member 42 is generally cylindrical and is closed by a domed upper wall 50. An inlet tube 52 is received within an opening formed in the center of the domed wall 50 and is brazed at 54. An outlet tube 56 extends through another opening in the domed wall 50 adjacent to the inlet tube 52, and it too is brazed to provide a pressure seal and a permanent juncture with the wall 50.

The outlet tube 56 extends vertically adjacent the inner wall of the accumulator and is curved at its lowermost portion, the curved portion being situated in the lowermost region of the accumulator adjacent to the lower wall 48. At the base of the accumulator within lower housing member 44 an oil return orifice and filter assembly structure is disposed as is commonly known in the art. The assembly comprises a plastic housing which is apertured and which includes a screen within the plastic housing. One end of the housing is curved so that it surrounds the outlet tube 56. The portion of the housing that surrounds the outlet tube is split and the ends are fastened together by a fastener to facilitate quick assembly. As will readily be apparent to one of ordinary skill in the art, any known oil return orifice and filter assembly may be used with the present invention, and the present invention is not meant to be limited to the assembly described herein.

As further shown, the accumulator 40 of the present invention includes an adsorbent device, such as a flexible bag of desiccant 62 interposed between the pipe portions of the outlet tube 56. The desiccant bag 62 is retained at its proper location by either a retaining clip 44 or by a simple wire tie assembly (not shown). The flexible desiccant bag 62 may be fabricated from any of a number of known materials. The adsorbent or desiccant in the bag may be any of a known adsorbent materials, such as a sealant gel, metal alumni silicate, alumna, calcium sulfate, activated charcoal, or any other desired compound in bead, pellet or granular form depending upon the circumstance of its use.

In order to prevent overheating of the desiccant, the desiccant bag or the retaining clip holding the desiccant bag to the outlet tube, the present invention provides means 66 for preventing the weld heat from damaging any of these components. The means for preventing the overheating of the interior of the accumulator 40 and resulting potential damage to any of the internal components comprises a heat shield 66 which includes an air gap spaced a predetermined distance from any of the internal components of the accumulator 40 as will be described in greater detail below.

As shown in FIG. 2, the upper housing member 42 includes the generally closed domed end 50 and a cylindrical wall projecting perpendicular therefrom. This wall terminates in an upper flange member 68 which extends axially from the wall around the entire circumference of the upper housing member 42. Likewise, the lower housing member 44 includes a generally closed end 48 with a generally cylindrical wall projecting perpendicularly therefrom. This wall terminates in a bottom flange member 70 which extends axially from the cylindrical wall of the lower housing member 44 around the entire circumference of the bottom housing member 44. This bottom flange member 70 is configured to engage the top flange member 68 so as to define a heat shield 66 when the upper flange member 68 and lower flange member 70 are joined together in abutting and overlapping relationship.

As shown in FIG. 2, the upper housing flange member 68 is generally arcuate in configuration while the lower housing flange member 70 is generally U-shaped. The upper housing member 68 is joined over the U-shaped lower flange member 70. The U-shape of the lower flange member provides an air gap 72 between the heat source during welding and the internal components, especially the outlet tube 56 & desiccant, of the accumulator 40. This air gap 72 provides an effective insulation for not allowing the transfer of the weld heat from the outside of the accumulator to the interior components of the accumulator while the upper housing member 42 is welded to the lower housing member 44 at weld seam 46. As such, none of the internal components are subjected to an overheating condition, thus preventing damage to any of the interior opponents.

FIGS. 3 and 4 show alternative embodiments of the heat shield 66 of the present invention to be employed with the above described accumulator 40. In FIG. 3, the upper flange member 74 is generally U-shaped to define the air gap 72 while the lower housing flange member 76 is generally arcuate in nature and is configured to be joined to the exterior side of the upper flange member 74. The upper flange member 74 is U-shaped to define the air gap 72 which provides the insulation effect as described above with reference to FIG. 2.

In FIG. 4, the upper housing flange member 78 is generally arcuate and extends around the entire circumference of the upper housing member while the lower housing member includes a generally U-shaped flange member 80. The U-shaped lower housing flange member 80 is configured such that the short end of the U is disposed to the exterior side of the accumulator as opposed to the interior side of the accumulator as shown in FIGS. 2 and 3. Similarly, the upper housing flange member 78 is joined to the exterior of the lower housing flange member 80 and an air gap 72 is provided thereby. This air gap, as described above, provides the insulating effect to prevent the weld heat from damaging any of the internal components of the accumulator 40.

It should be apparent that many variations and modifications of the present invention are possible without departing from the spirit and scope of the present invention. For example, the retaining clip used to hold the desiccant bag of material is shown as a polymeric material in FIGS. 2–4 but a simple wire tie assembly may be used to decrease cost and labor time since weld heat no longer penetrates the interior of the accumulator. These and other modifications will, no doubt, occurred to those skilled in the art. It is following claims, including all the equivalents which define the scope of the invention.

What is claimed is:

1. An accumulator for an automotive air conditioning system, comprising:

a generally cylindrical housing having a top housing member and a bottom housing member, the top and bottom housing members being joined together at a seam so as to define an internal cavity for storing a desiccant holder therein;

said top housing member including a generally closed end and a generally cylindrical wall projecting perpendicularly therefrom, said wall terminating in an upper flange member extending axially therefrom around the circumference of said top housing, said upper flange member being generally U-shaped and defining an air gap thereby;

said bottom housing member including a generally closed end and a generally cylindrical wall projecting perpendicularly therefrom, said wall terminating in a bottom flange member extending axially therefrom around the circumference of said bottom housing and configured to engage said upper flange member a fluid transport tube disposed through said top housing member and into said internal cavity;

a desiccant material stored in a desiccant holder with said internal cavity; and a heat shield including said air gap spaced a predetermined distance from said desiccant holder so as to prevent overheating of said desiccant holder while said top and bottom housing members are being joined.

2. An accumulator according to claim 1 wherein said heat shield comprises said upper and bottom flange members joined together.

3. An accumulator according to claim 1, wherein said upper flange member is generally arcuate.

4. An accumulator according to claim 3, wherein said bottom flange member is generally U-shaped and configured to engage said arcuate upper flange member.

5. An accumulator according to claim 1, wherein said bottom flange member is generally arcuate and configured to engage said U-shaped upper flange member.

6. An accumulator according to claim 1, wherein said upper and bottom flange members are joined by welding.

* * * * *